US007967664B2

(12) United States Patent
Elbing et al.

(10) Patent No.: US 7,967,664 B2
(45) Date of Patent: Jun. 28, 2011

(54) DEVICE AND PROCESS FOR CLEANING, ACTIVATION OR PRETREATMENT OF WORK PIECES BY MEANS OF CARBON DIOXIDE BLASTING

(75) Inventors: Felix Elbing, Berlin (DE); Raphael Rotstein, Brunnthal (DE); Marc Knackstedt, Berlin (DE)

(73) Assignee: CryoSnow GmbH, Berlin (DE)

( * ) Notice: Subject to any disclaimer, the term of this patent is extended or adjusted under 35 U.S.C. 154(b) by 751 days.

(21) Appl. No.: 11/815,514

(22) PCT Filed: Nov. 28, 2005

(86) PCT No.: PCT/EP2005/012866

§ 371 (c)(1), (2), (4) Date: Aug. 3, 2007

(87) PCT Pub. No.: WO2006/081856

PCT Pub. Date: Aug. 10, 2006

(65) Prior Publication Data

US 2008/0092923 A1 Apr. 24, 2008

(30) Foreign Application Priority Data

Feb. 5, 2005 (DE) ..... 10 2005 005 638

(51) Int. Cl.
*B24C 3/02* (2006.01)
*B24C 5/04* (2006.01)

(52) U.S. Cl. ..... 451/91; 134/94.1; 134/95.1; 451/99; 451/102

(58) Field of Classification Search ..... 451/2, 5, 451/7, 8, 38, 39, 40, 60, 91, 99, 102; 134/7, 134/115 R, 58 R, 93, 94.1, 95.1; 239/1, 8, 239/9, 11

See application file for complete search history.

(56) References Cited

U.S. PATENT DOCUMENTS

| | | | | |
|---|---|---|---|---|
| 4,389,820 | A * | 6/1983 | Fong et al. | 451/75 |
| 4,962,891 | A | 10/1990 | Layden | |
| 5,125,979 | A | 6/1992 | Swain et al. | |
| 5,390,450 | A * | 2/1995 | Goenka | 451/75 |
| 5,405,283 | A | 4/1995 | Goenka et al. | |
| 5,616,067 | A | 4/1997 | Goenka | |
| 5,785,581 | A * | 7/1998 | Settles | 451/99 |
| 6,390,898 | B1 * | 5/2002 | Pieper | 451/75 |
| 6,405,283 | B1 | 6/2002 | James | |

(Continued)

FOREIGN PATENT DOCUMENTS

JP 58-158599 A 9/1983

(Continued)

*Primary Examiner* — Timothy V Eley
(74) *Attorney, Agent, or Firm* — Paul & Paul

(57) ABSTRACT

The invention relates to a device and method for cleaning, activating or pre-treating workpieces by blasting a carbon dioxide snow which is produced from pressurized $CO_2$-containing fluids and at least one type of carrying compressed gas and is accelerated by means of a discharge nozzle (14), wherein a two-phase carbon dioxide mixture of a carbon dioxide gas and carbon dioxide particles is produced in an agglomeration chamber (8) by agglomerating and compressing carbon dioxide snow crystals which are radially added to the carrying gas in a multistage mixing chamber (10, 11, 12) comprising a central jet pipe (4), around which the carbon dioxide mixture circulates and which is used for supplying said carrying gas in such a manner that a high-energy turbulent gas flow for processing a workpiece is obtainable.

7 Claims, 1 Drawing Sheet

U.S. PATENT DOCUMENTS

Figure 1:
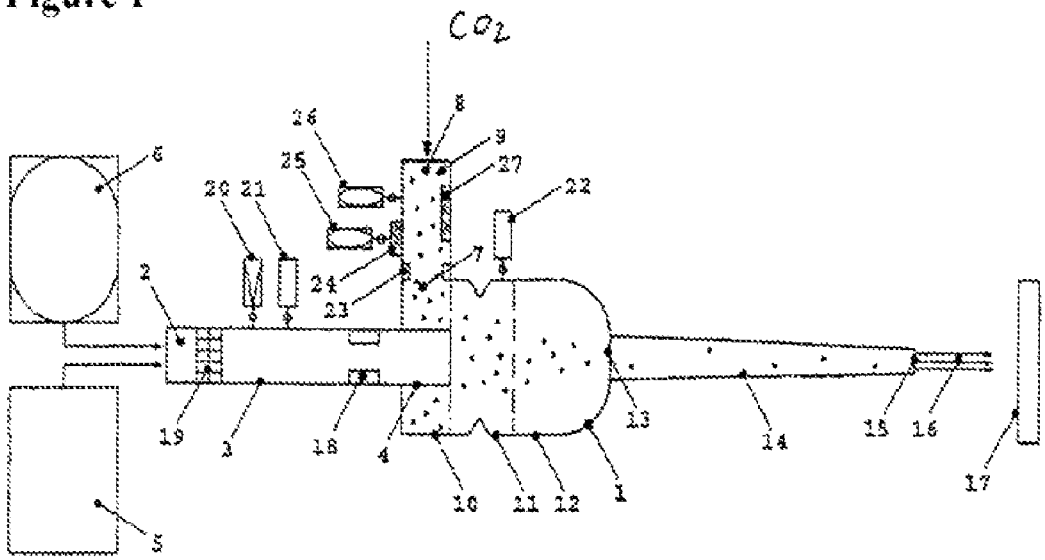

| | | | | |
|---|---|---|---|---|
| 6,695,686 | B1 | 2/2004 | Frohlich et al. | |
| 6,890,246 | B2 * | 5/2005 | Yamaharu | 451/99 |
| 7,442,112 | B2 * | 10/2008 | Yoon | 451/8 |
| 7,484,670 | B2 * | 2/2009 | Kipp | 239/11 |
| 2006/0011734 | A1 | 1/2006 | Kipp | |
| 2009/0032993 | A1 * | 2/2009 | Yokoyama | 264/212 |

FOREIGN PATENT DOCUMENTS

| | | | |
|---|---|---|---|
| JP | 2000-317410 | A | 11/2000 |
| JP | 2004-008995 | A | 1/2004 |
| WO | WO00/74897 | A1 | 12/2000 |
| WO | WO03/022525 | A2 | 3/2003 |
| WO | WO2004/033154 | A1 | 4/2004 |

* cited by examiner

DEVICE AND PROCESS FOR CLEANING, ACTIVATION OR PRETREATMENT OF WORK PIECES BY MEANS OF CARBON DIOXIDE BLASTING

The invention pertains to a device and a process for cleaning, activation or pretreatment of work pieces by means of carbon dioxide snow blasts, created by compressed carbon dioxide liquids and at least one compressed carrier gas, accelerated through an outlet nozzle, whereby a two-phase carbon dioxide mixture consisting of carbon dioxide gas and carbon dioxide particles, is created in an agglomeration chamber through agglomeration and compression of the carbon dioxide snow crystals and mixed with the carrier gas.

Blast processes and blasting devices for cleaning, pretreatment and activation of surfaces are state of the art technology for the past many decades. However, due to the tightening environmental laws and increased competition, a search is on, for the past few years, for a new, environment friendly and cost-efficient cleaning technology for industrial cleaning of tools, molds, plant and machinery, as well as components.

Surface treatment with various types of carbon dioxide has been described in inventions for over 30 years. Blasting with various forms of carbon dioxide is meanwhile already applied in a few branches of industry.

The document U.S. Pat. No. 4,962,691 describes a device for creation of a mixture made up of CO2 particles and CO2 gas from liquid CO2 and its acceleration at high speeds through a narrow slot nozzle, in order to remove impurities from a substrate material such as optical apparatus or wafers. With such applications it is usual practice to allow low energy density on the surfaces to be cleaned.

In the U.S. Pat. No. 5,616,067 a process and a device for cleaning of pressure sensitive surfaces with relatively low energy is described, wherein liquid CO2 is added to a central air flow (for special purposes even a nitrate flow) and accelerated according to the injector principle. The transformation to abrasive CO2 particles with very small dimensions, takes place in the gas flow itself, a decompression or agglomeration chamber for CO2 snow formation is not indicated. The recommended nozzle is of the known type with convergent—divergent cross-sectional form in longitudinal direction (axial direction) with variable oval or angular outlet cross-section. CO2 is introduced tangentially in the divergent outlet cross-section.

The document U.S. Pat. No. 6,405,283 describes a process and a device with which one can cool compressed air with low pressure using nitrate and which directs the ensuing gas together with expanded CO2 liquid into a chamber. Through a blasting nozzle with convergent and divergent cross-section for transporting, mixing and acceleration of CO2 particles at supersonic speed, the gas mixture for cleaning is directed on the substrate with strong adhesive impurities.

WO03/022525 describes a blast process and a blast device for cleaning of surfaces. With an adapter, an additional abrasive blast or liquid from a pressure source can be added to a blast medium with a blasting abrasive for e.g. dry ice. This arrangement should lead to a high blast performance and/or a broad diversification of the blast.

In document WO00/74897 A1 a blast tool for creation of a blast from CO2 snow with one nozzle and a second nozzle for creating a supporting blast, which surrounds the first blast, is described. The phase transformation from liquid CO2 takes place at the nozzle outlet of the first nozzle.

In document WO2004/033154 A1 a blast process and a blast device for cleaning of surfaces is described. To a carrier gas admitted centrically into a tube, compressed CO2 gas is transformed into dry snow and/or liquid CO2, in a decompression chamber, partly as dry ice particles and fed to the blast tube at a steep angle. The carrier gas flow thus works as an injector. The volume of carrier gas and/or liquid CO2 can be added through the flow control valve, the blast mixture can then preferably be directed, at the speed of sound, via a Laval nozzle, on the substrate to be cleaned. The cleaning effect should be enhanced by feeding water drops and/or ice pellets.

The present processes and devices for blasting with varying phases of CO2 could not be used in industrial application until now because of the costs for the dry ice pellets, the low possibility for automation, the high sound intensity levels, as well as the expensive logistics for gas and work pieces to be processed.

Often very weak blast performances are achieved and the diameter of the particles is too small and/or very low particle speeds are used. When blasting with CO2 pellets on the other hand, the substrate surface being processed gets damaged due to the large particle diameters. Moreover, the investment and operational costs are too high for a commercial application.

Taking the present level of technology into account, the problem for the invention is to provide a process and a device for cleaning, using carbon dioxide snow blasts, which will give high blast blasting performance, measured as a surface effect per time unit, during cleaning/pretreatment/activation of surface areas, while keeping the investment and operational costs low and not damaging substrate surface areas processed. In addition, the technology should have the capability of being automated in continuous operation, with minimum logistical expenses.

The problem is solved as per the invention through the features as claimed.

The first solution covers a process for cleaning, activation or pretreatment of work pieces by means of carbon dioxide snow blasts, created from compressed CO2 liquids and at least one compressed carrier gas, accelerated through an outlet nozzle, whereby a two-phase carbon dioxide mixture consisting of carbon dioxide gas and carbon dioxide particle, is formed in an agglomeration chamber through agglomeration and compression of carbon dioxide snow crystals and mixed with the carrier gas. Through an opening in the mixing chamber it is fed to a central gas blast influx of compressed carrier gas, added radially from the outside to the gas flow, mixed turbulently, accelerated in an outlet nozzle with the mixed turbulent gas and conducted to the work piece.

The mixing should preferably take place in a three-phase mixing chamber, whereby in the first phase of the mixing chamber, the two-phase carbon dioxide mixture flows uniformly around a blast tube that extends into the mixing chamber; in the second phase of the mixing chamber the gas flow that flows out from the blast pipe in the mixing chamber is fed into and turbulently mixed in the third phase of the mixing chamber.

In addition, as per the invention, the inner walls of the mixing chamber in the central or rear areas of turbulence formation, can be supported by means of a targeted predeterminable geometry, wherein the CO2 mixture is directed into the flow of the blast tube.

As a rule the process runs with a gas flow which is set at a temperature of 10° C. to 40° C. on entry in the mixing chamber; this is easily achievable when generating compressed air. As per the invention, however, the gas flow, on entry in the mixing chamber, can be set at a temperature higher than 50° C., for example by arranging for a heater at the blast tube. This helps in preventing condensation water from forming wither at the outlet nozzle or on the work piece. Through the ensuing higher average temperatures and/or temperature spread between carrier gas and CO2 mixture, the cleaning shock on the work piece is greater. Tests have shown improved cleaning results.

The mixing effect of the gases and the stabilization of the gas flow are supported, as per the invention, when the components to be mixed are impressed through corresponding fixtures in the device in a helical/spiral rotation.

The process becomes more powerful, if as per the invention, liquid drops, preferably water drops are added to the gas flow or the mixing chamber.

Further improvements in cleaning can be achieved as per the invention, in certain cases—type of surface to be processed or impurities or coatings to be blasted—if solid blast abrasive particles are added to the gas flow, preferably organic particles including flour, wood, plastic or inorganic particles such as finely ground solids made from silicon or salt. The functioning of the process and/or the device is not disturbed by this, but the result is better.

The process is supported during the agglomeration of the CO2 if the two-phase carbon dioxide mixture consisting of carbon dioxide gas and carbon dioxide particles, is cooled in the agglomeration chamber from outside, in front of the opening, preferably with liquid nitrate.

Similarly, in the two-phase carbon dioxide mixture consisting of carbon dioxide gas and carbon dioxide particles, inert liquid nitrate can be mixed in front of the opening, for the same purpose.

The second solution pertains to a device for cleaning, activation or pretreatment of work pieces by means of carbon dioxide snow blasts, especially to execute the described process, consisting of a blast device with an adjustable supply feature and pressure source for carrier gas and carbon dioxide liquid, an agglomeration chamber for creation of carbon dioxide snow crystals and a mixing feature for the carrier gas and CO2, as well as an outlet nozzle set behind, wherein the supply feature for the carrier gas is formed as an extended blast tube in the mixing feature. An agglomeration chamber for agglomeration and compression of carbon dioxide snow crystals in a two-phase carbon dioxide mixture with a dispenser opening that opens out in an annulus collector; the mixing feature as a multi-part mixing chamber is designed with an annulus collector at one end and with an outlet opening at the other end which opens out into the outlet nozzle.

As per the invention, the mixing chamber in the rear subpart can show a constriction or fixture for enhancing the turbulence of the gas flows.

In one model, the agglomeration chamber can preferably be designed as a tube with inner serrations, whereby the inner ridges of the agglomeration chamber run linear to the flow direction of the CO2, or are arranged in the form of a coil on the inner periphery of the tube. The formation of carbon dioxide snow can thereby be increased.

The outlet nozzle will mostly be a Laval nozzle, however, as per the invention, other shapes with flat cross-sections or round or ring-shaped outlets can be used and its use recommended, corresponding to the requirements, depending on whether large surfaces or bores, ridges, grooves etc. are to be cleaned. The limits—as per the present practical tests—of reasonably usable nozzles with good results are determined in the sub claims.

Tests conducted in the course of the invention have found that with conventional dispensing of blast abrasives to a carrier gas flow, greater performance losses arise. With the use of the three-phase mixing chamber as per the invention, one is able to supply the two-phase carbon dioxide mixture uniformly, without significant sublimation of carbon dioxide particles, as well as a homogenous turbulent mix of the gas flow.

The advantage of the invention is that the carbon dioxide particles are created in an agglomeration chamber from carbon dioxide snow crystals by means of agglomeration and compression processes. Extensive tests have shown that this method of creation of carbon dioxide particles enables higher blast performance when cleaning, activating or pre-treating surfaces as compared to present technology available. Thus one can save on investment and operational costs for cleaning and pretreatment of components, tools and molds, as well as plant and machinery. Through the use of carbon dioxide snow crystals the technology can be automated with continuous operation and run with low logistical expense.

Work material analysis of plastic and metal surfaces, as per the invention, have shown that no damage was caused to the substrate surface areas. With application of optimal temperature, flow and pressure ratios in the area of the agglomeration chamber, the mixing chamber and the nozzle, higher blast performance with uniform improvement of the cleaning quality can be achieved.

For automation of the process as per the invention, the parameters pressure, volume flow and/or temperature of the liquids used, are captured by a computer by means of sensors and compiled as well as regulated after comparison with stipulated or calculated reference values.

In addition, in a further development of the invention, even a relative movement of the outlet nozzle to the work piece to be processed can be regulated via a computer, thereby enabling any work piece to be captured according to its location and orientation and the surface coated with a blast device.

For automation, a control process is used, which accesses a pneumatic control through electrical control elements. The process and control parameters are compiled with the help of measuring sensors and supplied to the control computer as an electric signal.

The primary control of the carbon dioxide snow blast and/or device is done purely pneumatically, so that the process can be applied without an electrical connection. In addition, pneumatic components are clearly less susceptible to breakdown and maintenance, as compared to electrical ones.

In the case of a manual application of the invention, the logistics is even simpler as no electrical supply is needed.

Examples of application of the device as per the invention in a process as per the invention, described earlier:

EXAMPLE 1

The cleaning and pretreatment process for carbon dioxide snow blasts can be used industrially for the automatic cleaning of plastic components before the painting process. The aim is the complete cleaning of plastic components before the painting process i.e. the specific removal of grease, oils, release agents, finger prints, dust particles and swarf. Compressed air that does not contain any particles, oil or water is used as the carrier gas, which is created and finally prepared with a screw-type compressor. The carbon dioxide is supplied through a low-pressure tank. The set-up parameters for the blast pressure and the compressed air lie between 2 bar and 6 bar at a volume flow between 2 $m^3$/min and 6 $m^3$/min and for the pressure of the carbon dioxide between 18 bar and 22 bar. Depending on the size and the geometry of the surface area of the plastic component to be cleaned, as well as the required cycle time, a round and/or flat nozzle is used. With the help of a hex axial industrial robot, the nozzle is placed over the component to be cleaned. By means of a computer, the system parameters, in this case the pressures and volume flows of the compressed air and the CO2, as well as the speed and relative movement of the blast device and its position as compared to the work piece surface area to be processed, can be regulated.

The consumption of carbon dioxide is dependant on the nozzle used and the quantity as well as the adhesive force of the impurities on the plastic surface area and lies between 0.2 kg/min and 1.0 kg/min. In order to achieve the industrially stipulated cleaning requirements the feed rate of the blast nozzle lies between 200 mm/s and 600 mm/s. If a flat nozzle with a blast breadth of 80 mm is used, a surface area between 1 $m^2$/min and 3 $m^2$/min can be cleaned. Analysis of the surface area unit after cleaning is done visually with a light-optical microscope, as well as with a wipe test. In addition, an analysis of the painting system brought in subsequently is conducted.

Result:

The quality of the paint bonding and consistency can be increased as compared to conventional washing processes manual cleaning CO2 blasts with machines at present level of technology.

EXAMPLE 2

For cleaning of large injection molds that have a surface area of 1 $m^2$ to 8 $m^2$, burnt-in, highly adhesive, release agent residues must be removed from these tool surface areas. For this, compressed air with a blast pressure of 8 bar to 10 bar at a volume flow of 6 to 8 $m^3$/min is created through a screw-type compressor. The carbon dioxide is supplied with the help of stand pipe cylinders, preferably arranged in a cluster of cylinders. The carbon dioxide pressure lies between 40 and 60 bar. The cleaning device is supplied manually through the tool surface to be cleaned. Depending on the adhesive force and the quantity of the impurities on the mold surface, the cleaning performance will lie between 0.2 $m^2$/min and 1.0 $m^2$/min. The consumption of carbon dioxide with the use of a round nozzle with a blast diameter of 20 mm was 1 kg/min, The blast force, on one hand, was lost with the specific addition of water drops in the mixing chamber. On the other hand, control of the blast speed in the range of 100 m/s to 300 m/s proved beneficial.

Result:

By cleaning the molds with carbon dioxide snow blasts, the machine down time can be significantly reduced, mechanical damage through wire brushes used otherwise for cleaning can be avoided and costs can be reduced. The release agent residues can be rinsed away with the ensuing gas flow. In addition, the cleanliness of the mold surface can be improved, thereby improving the surface quality of the work piece injected in the mold.

The invention is explained in detail on the basis of a schematic diagram. It shows:

FIG. 1 a device for CO2 snow blasts as per the invention, wherein numerous models of the device are presented together in one diagram.

Figure 2:
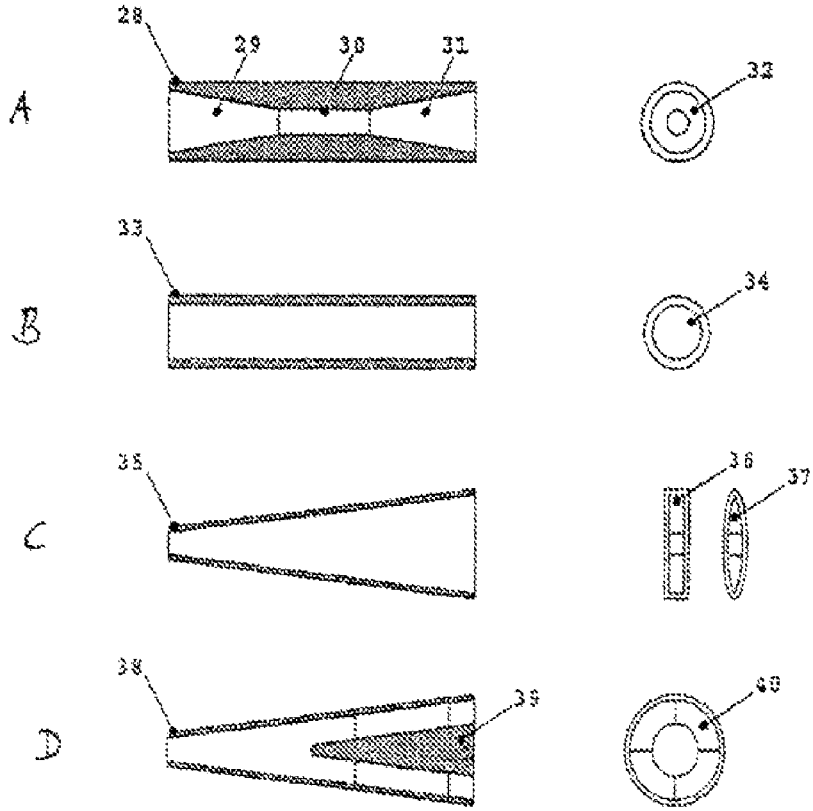

FIG. 2 various models—A, B, C, D—of an outlet nozzle for the device, as per FIG. 1.

FIG. 1 shows a device for carbon dioxide snow blasts. In the mixing chamber 1, a gas flow 2 is directed through a gas supply line 3 and a blast pipe 4 extending in the mixing chamber 1. The gas flow is clean, prepared air that is created in a compressor 5.

In special cases in the food industry or the optical industry, an inert gas such as nitrate, which is taken from a pressure tank 6, might be used.

Diagonal to the blast pipe 4 and the mixing chamber 1, an agglomeration chamber 8 for CO2 snow particles is set-up, which surrounds the blast pipe 4 on its outlet side. Through a valve not shown, the CO2 (arrow) is supplied in liquid form from a tank (not shown) to the agglomeration chamber 8 and decompressed there. Through a dispenser opening 7 at the periphery of the mixing chamber 1, a two-phase carbon dioxide mixture 9, consisting of carbon dioxide gas and carbon dioxide particles is supplied to the mixing chamber 1.

In the first area 10 of the mixing chamber 1, the two-phase carbon dioxide mixture circulates around the blast pipe 4 of the gas supply line 3, extending in the mixing chamber 1 and is radially added to the gas flow 2 in the second area 11 of the mixing chamber 1. In a third area 12 of the mixing chamber 1, turbulent mixing of the two-phase carbon dioxide mixture 9, consisting of carbon dioxide gas and carbon dioxide particles with the gas flow 2, is conducted.

A mixed gas flow with carbon dioxide particles flows from the outlet opening 13 of the mixing chamber 1 to an outlet nozzle and is accelerated there. A carbon dioxide snow blast 16 comes out from the nozzle opening 15, which can be used to clean, pre-treat or activate a work piece surface 17.

Given below are descriptions of further models of the device for carbon dioxide snow blasts in which the additional components and/or measures enable increase of the degree of automation of the process, as also more precise control and adjustment of the processing task on hand.

Control through a computer is not shown explicitly a pneumatic control is preferred, wherein the sensors and correcting elements are arranged on all functional units, which are still to be explained in detail below. The same applies to a robot which—for e.g. as per the application examples—can be equipped with one of the described models of the device, as also gas containers.

Alternatively, the device, as basic equipment for small surface applications, can also be designed as portable "Rucksack devices" for manual applications.

Model 2:

In order to increase the turbulent mixing in the third area 12 of the mixing chamber 1 and thereby improving the blast performance, mechanical fixtures 18 are placed on the inner periphery of the gas supply line 3 and/or the pipe 4 extending in the mixing chamber 1, which transfers the gas flow 2 into screw-type rotations/turns and thereby stabilizes the flow.

Model 3:

In order to increase the temperature of the gas flow 2 so as to improve the blast performance and to reduce the moisture condensation on the work piece surface 17, a heater 19 with temperature sensors is integrated in the gas supply line 3 in front of the pipe 4 extending in the mixing chamber 1.

Models 4/5:

In order to improve the blast performance and/or to achieve specific characteristics of the surface, after cleaning, pre-treating and/or activation, solid blast abrasive particles through a blast abrasive dispensing system 20 and/or water drops through a liquid dispensing system 21 and/or corrosion resistant substances, preferably phosphate, are added to the gas flow 2, in the gas supply line 3 in front of the pipe piece 4 extending in the mixing chamber 1.

Model 6:

In order to improve the blast performance and/or to achieve specific characteristics of the surface, after cleaning, pre-treating and/or activation, water drops and/or corrosion-resistant substances, preferably phosphate, and/or solid blast abrasive particles are introduced directly into the mixing chamber, preferably in the first area 10 and/or second area 11 of the mixing chamber 1 by means of a feed system 22.

Model 7:

In order to improve the dispensing and the turbulent mixing in the mixing chamber 1, mechanical fixtures 23 are placed on the inner periphery of the dispenser opening 7 on the perimeter of the mixing chamber 1, which transfer the two-phase carbon dioxide mixture consisting of carbon dioxide gas 8 and carbon dioxide particles 9 into screw-type rotations Model 8:

In order to enlarge the carbon dioxide particles 9 and in order to increase the mass flow rate to the carbon dioxide particles, thereby improving blast performance, the two phase carbon dioxide mixture, consisting of carbon dioxide gas and carbon dioxide particles 9, is cooled from the outside with a cooling system 24 having thermo sensors with liquid nitrate from the reservoir 25, before being fed into the mixing chamber 1 through the dispenser opening 7.

Model 9:

Another possibility of cooling is the direct dispensing of liquid nitrate from a nitrate dispenser system 26, in the two-phase carbon dioxide mixture, consisting of carbon dioxide gas and carbon dioxide particles 9, before being fed into the mixing chamber 1 through the dispenser opening 7.

Model 10/11:

Another possibility of improving the blast performance by increasing and compacting the carbon dioxide particles 9, is the use of inner serration 27 before feeding of the two-phase carbon dioxide mixture in the mixing chamber 1 through the dispenser opening 7. The inner serration 27 helps the avoidance of snow formation in the agglomeration chamber and leads to carbon dioxide snow crystals adhering to bigger and denser carbon dioxide particles 9. The inner serration of the chamber designed as a finned pipe runs linear to the flow direction, —naturally in all models of the device, through a nozzle not shown, with predetermined or adjustable cross-section—from a source of liquid flowing CO2 (arrow).

The blast performance can be additionally increased if the inner serration 27 of the finned pipe is designed in the shape of a coil on the inner periphery of the chamber 8.

FIG. 2 shows a few models—A, B, C, D, for the nozzle 14 from which the carbon dioxide snow blast 16 comes out of the nozzle opening 15 and can be used for cleaning, pre-treating and activation of a work piece surface 17.

FIG. 2A: As nozzle 14 one can use a Laval nozzle 28 with convergent section 29, a cylindrical section 30 and a divergent section 31. The geometry of the outlet cross-section corresponds to a circle 32.

FIG. 2B: The device for carbon dioxide snow blasts offers the possibility, depending on application, of round nozzles 33 with an outlet cross-section of the geometry of a circle 34.

FIGS. 2C/2D: Flat nozzles 35 with an outlet cross-section of the geometry of a right angle 36 and/or an ellipse 37, as also ring nozzles 38 with flow fixtures 39 and an outlet cross-section surface of the geometry of a circular ring 40, can be used.

The invention claimed is:

1. Device for cleaning, activation or pre-treatment of work pieces by means of a gas flow comprising a blast device with adjustable feed attachments and pressure sources for a carrier gas, an agglomeration chamber for creating carbon dioxide snow crystals and a mixing device for the carrier gas and carbon dioxide, as well as an outlet nozzle attached and extending from the mixing device, characterized by the fact that— a feed attachment (3) for the carrier gas is designed as a blast tube (4) extending into the mixing device (1), the agglomeration chamber (8) designed as a tube with inner serration (27) has a dispenser opening (7), which opens out into an annular space (10), and the mixing device (1) has a plurality of mixing chambers and an outlet opening (13) at a first end, which opens out into the outlet nozzle, wherein one of the mixing chambers is the annular space (10) and located at a second end of the mixing device (1).

2. Device as per claim 1, characterized by the fact that the inner serration (27) of the agglomeration chamber (8) runs linear to the flow direction of the carbon dioxide (arrow).

3. Device as per claim 2, characterized by the fact that the mixing device (1) has a fixture located on the inner surface of at least one of the feed attachment (3), the blast tube (4), and the dispenser opening (7) for increasing the turbulence of the gas flow in the mixing device (1).

4. Device as per claim 1, characterized by the fact that the agglomeration chamber has an inner periphery and the inner serration of the agglomeration chamber (8) is arranged in the form of a coil on the inner periphery.

5. Device as per claim 4, characterized by the fact that the mixing device (1) has a fixture located on the inner surface of at least one of the feed attachment (3), the blast tube (4), and the dispenser opening (7) for increasing the turbulence of the gas flow in the mixing device (1).

6. Device as per claim 1, characterized by the fact that the mixing device (1) has a fixture located on the inner surface of at least one of the feed attachment (3), the blast tube (4), and the dispenser opening (7) for increasing the turbulence of the gas flow in the mixing device (1).

7. Device for cleaning, activation or pre-treatment of work pieces by means of a gas flow comprising a blast device with adjustable feed attachments and pressure sources for a carrier gas and carbon dioxide liquid, an agglomeration chamber for creating carbon dioxide snow crystals and a mixing device for the carrier gas and carbon dioxide, as well as an outlet nozzle attached and extending from the mixing device, characterized by the fact that— a feed attachment (3) for the carrier gas is designed as a blast tube (4) extending into the mixing device (1), the agglomeration chamber (8) has a dispenser opening (7), which opens out into an annular space (10), the mixing device (1) has a plurality of mixing chambers and an outlet opening (13) at a first end, which opens out into the outlet nozzle, wherein one of the mixing chambers is the annular space (10) and located at a second end of the mixing device (1), and a fixture located on the inner surface of at least one of the feed attachment (3), the blast tube (4), and the dispenser opening (7) for increasing the turbulence of the gas flow in the mixing device (1).

* * * * *

UNITED STATES PATENT AND TRADEMARK OFFICE

CERTIFICATE OF CORRECTION

PATENT NO. : 7,967,664 B2
APPLICATION NO. : 11/815514
DATED : June 28, 2011
INVENTOR(S) : Felix Elbing, Raphael Rotstein and Marc Knackstedt It is certified that error appears in the above-identified patent and that said Letters Patent is hereby corrected as shown below:

Column 8, line 7, reads "the agglomeration chamber (8) designed as a tube with"
should read -- the agglomeration chamber (8) is designed as a tube with --

Signed and Sealed this
Twentieth Day of September, 2011

David J. Kappos

David J. Kappos
*Director of the United States Patent and Trademark Office*